US008610354B2

(12) United States Patent
Schuermann et al.

(10) Patent No.: US 8,610,354 B2
(45) Date of Patent: Dec. 17, 2013

(54) METHOD AND APPARATUS FOR THE GENERATION OF SHORT-WAVELENGTH RADIATION BY MEANS OF A GAS DISCHARGE-BASED HIGH-FREQUENCY, HIGH-CURRENT DISCHARGE

(75) Inventors: Max Christian Schuermann, Luebbecke (DE); Lutz Dippmann, Bovenden (DE); Juergen Kleinschmidt, Jena (DE); Guido Schriever, Goettingen (DE)

(73) Assignee: XTREME technologies GmbH, Aachen (DE)

( * ) Notice: Subject to any disclaimer, the term of this patent is extended or adjusted under 35 U.S.C. 154(b) by 64 days.

(21) Appl. No.: 13/311,023

(22) Filed: Dec. 5, 2011

(65) Prior Publication Data

US 2012/0153829 A1 Jun. 21, 2012

(30) Foreign Application Priority Data

Dec. 21, 2010 (DE) ..... 10 2010 055 889

(51) Int. Cl.
*H01J 7/24* (2006.01)

(52) U.S. Cl.
USPC ..... 315/111.21; 315/111.01; 315/111.31; 315/111.41

(58) Field of Classification Search
USPC ..... 315/121.21, 111.21; 250/504 R, 492.2
See application file for complete search history.

(56) References Cited

U.S. PATENT DOCUMENTS 6,551,447 B1 * 4/2003 Savas et al. ..... 156/345.48
6,566,667 B1 * 5/2003 Partlo et al. ..... 250/504 R
6,744,060 B2 * 6/2004 Ness et al. ..... 250/504 R
6,815,700 B2 * 11/2004 Melnychuk et al. ..... 250/504 R
7,180,083 B2 * 2/2007 Partlo et al. ..... 250/504 R
7,250,621 B2 * 7/2007 Gaebel et al. ..... 250/504 R
7,528,395 B2 * 5/2009 Koshelev et al. ..... 250/493.1
7,605,385 B2 * 10/2009 Bauer ..... 250/504 R
RE41,362 E * 6/2010 Koshelev et al. ..... 250/492.2
7,750,574 B2 * 7/2010 Saito et al. ..... 315/111.21
7,914,692 B2 * 3/2011 Saito et al. ..... 216/67
2008/0258085 A1 10/2008 Bauer

FOREIGN PATENT DOCUMENTS

DE 10361908 A1 7/2005
JP 61101942 A 5/1986

* cited by examiner

*Primary Examiner* — Daniel Cavallari
*Assistant Examiner* — Srinivas Sathiraju
(74) *Attorney, Agent, or Firm* — Patentbar International, P.C.

(57) ABSTRACT

The invention is related to a gas discharge-based radiation source which emits short-wavelength radiation, wherein an emitter is ionized and compressed by pulse-shaped currents between two electrodes arranged in a vacuum chamber and is excited to form an emitting plasma. According to the invention, the plasma is preserved by means of a high-frequency sequence of pulse-shaped currents the pulse repetition period of which is adjusted so as to be shorter than a lifetime of the plasma so that the plasma is kept periodically alternating between a high-energy state of an emitting compressed plasma and a low-energy state of a relaxing plasma. For exciting the relaxing plasma to the compressed plasma, excitation energy is coupled into the relaxing plasma by making use of pulse-shaped currents with repetition frequencies between 50 kHz and 4 MHz and pulse widths equal to the pulse repetition period.

14 Claims, 3 Drawing Sheets

METHOD AND APPARATUS FOR THE GENERATION OF SHORT-WAVELENGTH RADIATION BY MEANS OF A GAS DISCHARGE-BASED HIGH-FREQUENCY, HIGH-CURRENT DISCHARGE

RELATED APPLICATIONS

This application claims priority to German Patent Application No. DE 10 2010 055 889.3, filed Dec. 21, 2010, which is incorporated herein by reference in its entirety.

FIELD OF THE INVENTION

The invention is directed to a method and an apparatus for the generation of short-wavelength radiation by means of a gas discharge-based high-current discharge, particularly in the EUV range.

Short-wavelength radiation (wavelength <100 nm) in the range of extreme ultraviolet radiation (EUV range) is used for a number of applications, but particularly for semiconductor lithography. Special radiation sources based on the emission of a hot plasma are used for this purpose.

In radiation sources which are based on a plasma generated by gas discharge, an electric voltage is applied to at least two electrodes in a chamber under low pressure or vacuum, and an electric field for a high-current discharge is generated between the electrodes. The voltages required for this purpose are in the range of several kilovolts. The selected geometric arrangement of the electrodes is often rotationally symmetric.

When the field strength is high enough and molecules or atoms of an emitting material (emitter) suitable for the desired wavelength region are located in the electric field, the charges are separated from at least some of the molecules and/or atoms and an ionization of the emitter is brought about between the electrodes (discharge volume). Usually, additional devices are provided by means of which the discharge volume is brought to a state of increased ionization prior to the actual discharge (preionization).

The free charge carriers generated by the ionization reduce the electric resistance between the electrodes and allow a flow of current and charge balancing between these electrodes. An azimuthal magnetic field is generated by the current flow and extends in a rotationally symmetric manner around the region of the current flow. There are charge carriers of both signs present in the plasma (quasi-neutral plasma). The charge carriers (ions and electrons) moving in the electric field are accelerated by the effect of the Lorentz force in direction of the axis of the magnetic field and are compressed (pinch effect) in a small volume along an axis between the electrodes. This increases the density of the plasma and, owing to increasing collisions between the ions, also raises the temperature of the plasma which is compressed in this way and which then emits radiation in a desired wavelength range specific to the respective emitter. For example, noble gases or elements of the fifth main group of the periodic table of elements (or compounds thereof) can be used as emitters for generation of EUV radiation around 13 nm.

Because of the high current strengths required for sufficiently high ionization and heating of the emitter, the plasma can only be generated in a pulsed manner. Accordingly, the plasma only persists over a certain time interval, designated hereinafter as the lifetime of the plasma, corresponding to the duration of the current pulses.

During the radiation emission of the compressed plasma, this plasma starts to expand and relax (relaxing plasma). A relaxing plasma will cease to emit short-wavelength radiation after a period of relaxation and corresponding expansion.

However, for soft x-ray (EUV radiation) applications, a continuously high photon flow is usually necessary. Further, it is desirable to keep the emitted power of the radiation as constant as possible. Therefore, due to the fact that the plasma is generated periodically, stable pulse repetitions are required for machining processes with soft x-ray radiation (EUV) in that pulse-shaped currents are supplied to the electrodes at the highest possible pulse repetition frequency f.

Particularly high pulse repetition frequencies are required for semiconductor lithography because, in this way, the emitted power of the radiation source is increased and the uniformity of the radiation emission, or dose stability as it is called, can also be improved. The dose stability of the plasma-based radiation source is determined particularly by the pulse-to-pulse stability and spatial stability of the source volume, i.e., the size and location of the volume of emitting plasma.

An emission duration $t_{emi}$, i.e., that time interval over which the plasma actually emits the desired radiation, is shorter than the lifetime of the plasma and appreciably shorter than the period of the pulse repetition frequency f and at a pulse repetition frequency of f≈5 . . . 10 kHz is usually less than 1 μs. Therefore, there is a mean emission ratio $fr*t_{emi}$ of less than 1%, typically even less than 1‰ of the period of the pulse repetition (percentage of the emission duration of the period duration of the pulse repetition). Accordingly, the mean emitted output of the plasma can be increased by lengthening the emission duration $t_{emi}$ at the same pulse repetition frequency f.

BACKGROUND OF THE INVENTION

Known gas discharge-based plasma radiation sources operate at pulse repetition frequencies of <10 kHz, but there are known electrodeless approaches which work at a substantially higher pulse repetition frequency of more than 10 MHz as is disclosed in U.S. Pat. No. 7,605,385 B2. In these methods, the compression of the plasma is implemented through the effect of external magnetic fields and not by a pinch effect which is generated by the current flowing through the plasma.

To achieve the high current strengths of more than 10 kA which are required for a gas discharge-based plasma radiation source, special circuits were developed by which very high outputs (several joules in less than 1 μs) are supplied briefly in the form of pulse-shaped currents and by which, at the same time, disadvantageous effects such as feedback to the technical equipment supplying the pulse-shaped currents can be efficiently reduced. A circuit of this kind is described, for example, in DE 103 61 908 A1.

An apparatus for generating high-energy radiation which works according to the principles described above is described in U.S. Pat. No. 6,566,667 B 1. The apparatus comprises a pulse power source and a vacuum chamber having at least two electrodes between which a buffer gas and a working gas or working gas mixture are injected. The pulse power source has a charging capacitor bank which can be charged in less than 0.5 μs by a charging circuit. Further, devices are provided for controlling the charging process, namely, a magnetic compression circuit having a saturable inductor and at least one charging capacitor bank, a charging bank switch for discharging the latter into the magnetic compression, and a pulse transformer for increasing the pulse voltage by at least a factor of four. The apparatus can be operated without preionization, but appreciably better results with respect to conversion efficiency (ratio of generated radiation output to electric input power) and stability of emission are achieved with preionization.

SUMMARY OF THE INVENTION

It is the object of the invention to find a novel possibility for generating short-wavelength radiation by means of radiation sources based on a gas discharge-generated plasma in which the emission duration of the plasma which is insufficient with respect to the pulse period is improved and an emission of short-wavelength radiation remaining constant with respect to time is achieved with high dose stability.

In a method for exciting a gas discharge-based radiation source emitting short-wavelength radiation in which, by means of pulse-shaped currents between two electrodes arranged in a vacuum chamber, an emitter is ionized and periodically compressed between the electrodes and is excited to form a pulsed emitting plasma which emits the desired short-wavelength radiation by each pulse over an emission duration, the above-stated object is met in that the plasma is maintained uninterruptedly by means of a high-frequency sequence of pulse-shaped currents by setting a pulse repetition period of the pulse-shaped currents which is shorter than a lifetime of the plasma corresponding to the duration of the presence of the plasma so that the plasma is kept periodically alternating between a high-energy state of an emitting compressed plasma and a low-energy state of a relaxing plasma, and for an excitation of the relaxing plasma for generating the compressed plasma, an excitation energy is coupled into the relaxing plasma in that pulse repetition frequencies between 50 kHz and 4 MHz with pulse widths which are equal to the pulse repetition period are used for the pulse-shaped currents.

The invention is based on the consideration that an improved adaptation of the pulse repetition frequency of the pulse-shaped currents to the lifetime of the emitting plasma (emission duration) must be carried out in order to increase the output power and the constancy of the radiation emission and dose stability of a gas discharge-based radiation source working with electrodes.

This adaptation is carried out, according to the invention, in that a next pulse is supplied already after a first discharge when a generated emitting plasma is still at least partially present as (no longer emitting) residual plasma so that a flow of current begins again owing to a discharge facilitated by the residual plasma. The residual plasma is increasingly ionized by the renewed current flow and is converted by the reoccurring pinch effect into the high-energy state of the compressed plasma having a small source volume which emits the desired short-wavelength radiation over a further emission duration $t_{emi}$.

Once a plasma has been generated, it is kept in a periodically alternating manner in an energy-excited plasma state of emitting compressed plasma and relaxing, no-longer-emitting plasma by means of the mutually adapted values of pulse repetition frequency and pulse width of the excitation and lifetime of the plasma so that a complete "extinction" of the plasma does not take place, and the process of energy recharging can be understood as "plasma recycling". Owing to this plasma recycling, the conversion efficiency of electric energy into short-wavelength radiation is increased compared to methods in which the plasma is always being re-formed again, since the energy-wasting initial preionization of the emitter particles and the heating of the emitter with every successive pulse are dispensed with.

At every maximum of the current flow, the plasma is compressed (pinch effect) once by the effect of the current-induced magnetic field. If an AC current is applied, the compression takes place twice per cycle of AC current, wherein the direction of current reverses once. Pulsed DC current can also be used instead of AC current, in which case the voltage form can have different shapes such as, e.g., a sinusoidal, triangular, or rectangular shape.

The plasma cools between the individual current strength maxima because of radiation emission and spatial expansion of the plasma, but remains in an ionized state. During the emission, the plasma temperature is typically ~30-40 eV. The emission of EUV radiation lapses between pulses, but the emitter particles remain substantially ionized so that the plasma temperature decreases to the range of a few electron volts (e.g., 1 . . . 10 eV). The electrical resistance between the electrodes is permanently low due to the residual ionization so that the voltage range <1 kV can also be used, whereas known prior art radiation sources typically use voltages of several kilovolts.

At the very high pulse repetition frequencies of 50 kHz to 2 MHz in the method according to the invention, emission durations $t_{emi}$ of ≥1% of the cycle of the excitation frequency (pulse repetition period) are achieved. In an optimal embodiment of the invention, the plasma is operated at a pulse repetition frequency $f=1/t_{emi}$ which corresponds to the reciprocal of the emission duration $t_{emi}$. In so doing, the plasma also emits short-wavelength radiation between the maximum current values (quasi-continuous operation).

The shape of the pulse-shaped currents is advantageously selected and used as a function from the group comprising sinusoidal, triangular and rectangular functions. Further, any pulse shape can be used as the shape of the pulse-shaped currents, provided it is constantly recurring.

Preferably, no more than 1 joule of excitation energy is injected into the relaxing plasma for every excitation of the relaxing plasma for generation of compressed plasma. This reduces damage to the surfaces of the components arranged in the vicinity of the plasma and lowers the amount of energy supplied for generating short-wavelength radiation.

For a continuous implementation of the method according to the invention, it is advantageous when the pulse repetition frequency f is adapted to the natural frequency f0 of the resonant circuit.

Further, it is advantageous for generation of short-wavelength radiation when the emission duration $t_{emi}$ is at least 1% of the pulse repetition period.

The pulse-shaped currents can be supplied as AC currents and also as pulsed DC currents with any amplitude waveform with respect to time (e.g., rectangular or sinusoidal). In this respect, it is advantageous when the pulse repetition frequency and amplitude of the AC currents in the circuitry can be set substantially independently from one another because, in this way, the parameters can be adapted to the electrical characteristics of the installation and the emission characteristics can be optimized. True AC currents offer the advantage over pulsed DC currents that the net movement of the ions and electrons in the plasma is equal to zero.

AC currents with a frequency of 50 kHz to 2 MHz or pulse-shaped currents of pulsed DC currents with a frequency of 100 kHz to 4 MHz are preferably used as pulse-shaped currents.

In the method according to the invention for supplying the pulse-shaped currents, a peaking circuit is preferably used which contains at least the following elements and component groups: a resonant circuit, a high-frequency generator for inductive excitation of the resonant circuit, and a capacitor C, wherein the capacitor C has an electric capacitance of 300 nF to 600 nF;

the peaking circuit has an inductance L of 20 nH to 30 nH; and the peaking circuit has an electrical resistance R of 0.025Ω to 0.05Ω.

In a preferred embodiment of the method according to the invention, capacitor C is recharged by a timed supply of electric energy when a certain portion of the energy originally deposited therein has been dissipated in the plasma.

The above-stated object is further met by an apparatus for the excitation of a gas discharge-based radiation source emitting short-wavelength radiation by means of a high-frequency high-current discharge in which at least two electrodes are provided in a vacuum chamber in which an emitter is located between the electrodes, and means are provided for generating pulse-shaped currents between the electrodes at a high pulse repetition frequency, characterized in that a peaking circuit comprising a resonant circuit, a high-frequency generator for inductive excitation of the resonant circuit and at least one capacitor is provided as means for generation of pulse-shaped currents, wherein a first capacitor, a resistor, an inductor L, and a second capacitor are arranged successively in the resonant circuit and are electrically conductively connected to one another in the above-mentioned sequence, wherein the first capacitor is electrically conductively connected to the second capacitor;

a charging circuit is provided for electrically recharging the first capacitor; and the peaking circuit is electrically contacted through a line of the charging circuit between the first capacitor and the resistor, and a switch is arranged in the line of the charging circuit for switching the line of the charging circuit; and another switch is provided between the capacitor and the resistor for switching the electrically conducting connection between the capacitor and the resistor so as to allow a timed recharging of the capacitor.

The invention makes it possible to generate short-wavelength radiation by means of radiation sources based on a gas discharge-generated plasma in which the emission duration of the plasma is improved relative to the pulse period and an emission of short-wavelength radiation remaining constant with respect to time and having high dose stability is achieved.

BRIEF DESCRIPTION OF THE DRAWINGS

The invention will be described more fully in the following with reference to embodiment examples. The drawings show.

DETAILED DESCRIPTION OF THE PREFERRED EMBODIMENTS

Figure 1:
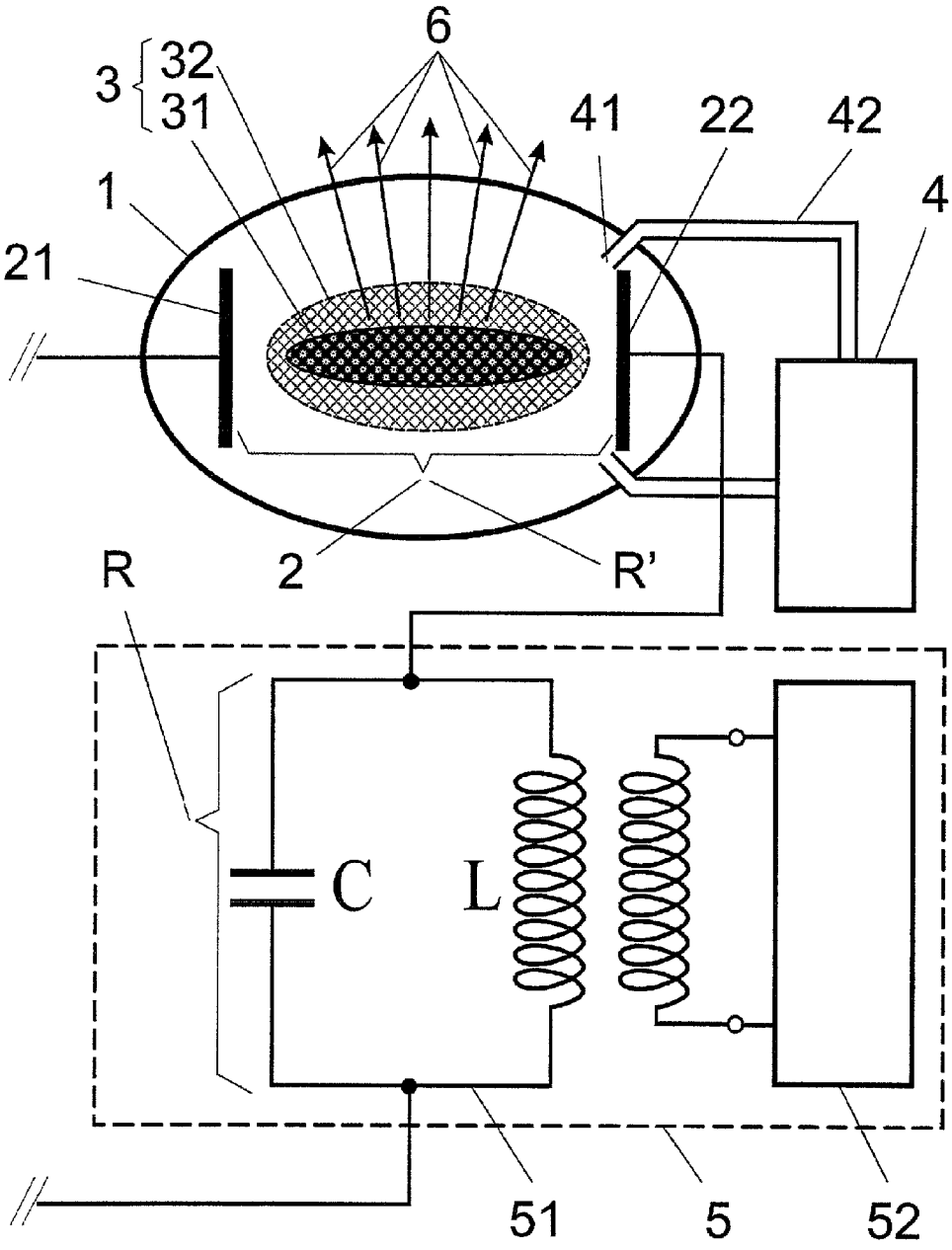
FIG. 1 a schematic diagram of a first embodiment example of the apparatus according to the invention having a series connection of electrodes to a resonant circuit.

The embodiment examples relate to circuits which allow the above-mentioned discharge conditions to be met. In the following, it will be shown how a circuit of this type must be constructed in principle so that a discharge capable of producing a desired output PEUV can be generated in the first place. The circuits shown in the drawing are equivalent circuits in which the plasma characteristics are characterized by the inductance L' of the plasma 3 and the electrical resistance R' of the plasma 3.

In its basic construction according to FIG. 1, the invention comprises a discharge gap 2 arranged in a vacuum chamber 1 between two electrodes 21 and 22 in which a gaseous emitter supplied by an emitter delivery unit 4 is changed into plasma 3 as a result of an electric discharge between the electrodes 21 and 22, and a peaking circuit 5 which is connected to electrodes 21 and 22 and has a resonant circuit 51 and a high-frequency generator 52 for driving the resonant circuit 51. The arrangement of the resonant circuit 51, electrodes 21, 22 and discharge gap 2 is also referred to hereinafter as discharging circuit.

The high-frequency generator 52 is realized by a high-power oscillator circuit such as is used in high-frequency technology. The high-frequency generator 52 is capable of generating the required voltage pulses with several hundred volts to a few kV at a pulse repetition frequency of 100 kHz to 4 MHz. The total output of the high-frequency generator 52 is in the range of 5 to 5000 kW. It is inductively coupled with the resonant circuit 51 and drives the latter.

The resonant circuit 51 (shown in a highly generalized manner, EN 60617-4: 1996) is an LC circuit with an inductor L and a capacitor C and has a resistor R. A pulse-shaped current in the form of an AC current with a selected minimum pulse repetition frequency of 50 kHz is supplied periodically by the resonant circuit 51. Therefore, the period duration is 2 μs resulting in current pulses with alternating polarity at an interval of 1 μs. A gas or vapor or a mixture thereof is used as gaseous emitter. The gaseous emitter is streamed into the region of the electrodes 21 and 22 via an adjustable gas inlet 41 and a corresponding gas feed 42.

In an alternative embodiment of the invention, the emitter can also be supplied in the region between electrodes 21 and 22 by evaporation of a solid or liquid material which must then be replenished due to the required material volume. The liquid or solid emitter can also be applied to electrodes 21 and 22 regeneratively and can be evaporated therefrom (not shown). In the latter case, the emitter is preferably applied to one of the electrodes 21 or 22 regeneratively and vaporized locally by a laser (not shown).

Figure 2:
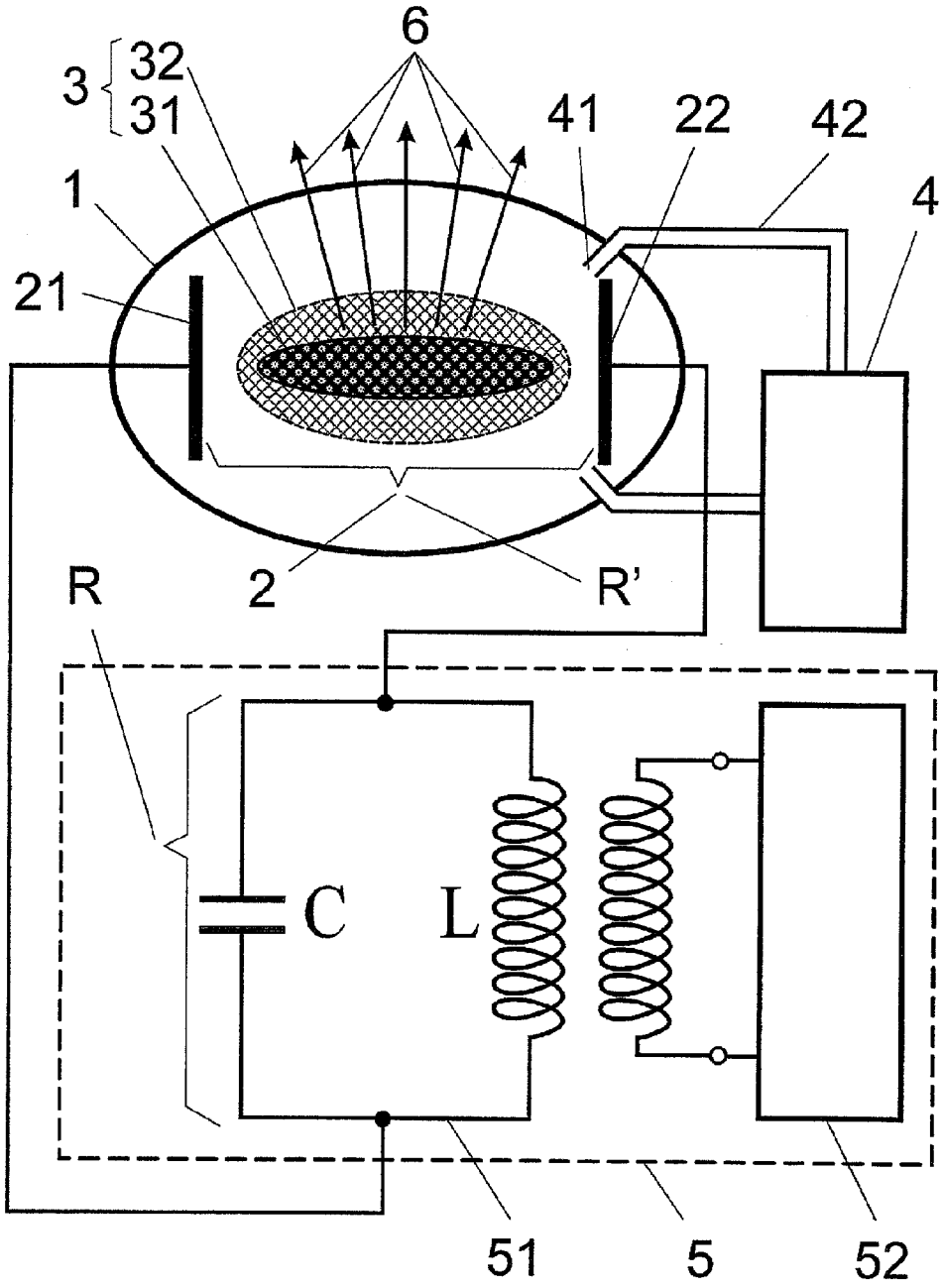
FIG. 2 a schematic diagram of a second embodiment example of the apparatus according to the invention having a parallel connection of electrodes to a resonant circuit.

The electrodes 2 and the plasma 3 generated therein can be connected to the resonant circuit 5 either in series (shown highly schematically in FIG. 1) or in parallel (shown highly schematically in FIG. 2). The peaking circuit 5 for supplying current for the gas discharge in the discharge gap 2 can be realized in a particularly simple manner in that the discharge gap 2 is connected in series with the plasma 3 between electrodes 21 and 22 and the resonant circuit 51. In this case, the plasma 3 between the electrodes 21 and 22 forms the resistor R'. If the electrical resistance R of the rest of the resonant circuit 51 is sufficiently low, the resistance R' of the plasma 3 forms the predominant contribution to electrical resistance.

The desired natural frequency of the resonant circuit 51 can be adjusted through a suitable selection of inductance L and capacitance C according to the following formula:

$$f_0 = \frac{1}{2\pi}\sqrt{\frac{1}{LC} - \frac{R^2}{4L^2}} \tag{1}$$

In this connection, the influence of the resistance R on the natural frequency f0 for realistic values of L=5 . . . 100 nH and C=100 . . . 1000 nF is minor.

In this case (in contrast to otherwise conventional pulsed discharge-based plasma radiation sources), it is not necessary to adapt the impedance of the resonant circuit 51 to the electrical resistance R' of the plasma 3 because the electric energy that is not coupled into the plasma 3 is recovered almost in its entirety at a sufficiently low electrical resistance R of the resonant circuit 51. The frequency matching between excitation and natural frequency f0 of the resonant circuit 51 results in a damped oscillation, and only resistive losses occur in the inductor L having a resistance R1 and in the capacitor C having a resistance R2. The energy deposited in the plasma 3 per half-oscillation is kept smaller than the energy available in the resonant circuit 51 by a high reactive current in the resonant circuit 51. This facilitates driving of the resonant circuit 51 by intensified feedback.

At a given power P to be deposited in the plasma 3 and a given resistance R' of the plasma 3, the effective current strength in the resonant circuit 51 is $$I_{eff} = \sqrt{\frac{P}{R'}} \tag{2}$$

This is not dependent upon the frequency of the pulse-shaped currents. Accordingly, a low resistance R' of the plasma 3 is desirable to maximize the current strength at a given maximum power P.

In the peaking circuit 5, the resonant circuit 51 is driven by the high-frequency generator 52 and begins to oscillate at a desired pulse repetition frequency f. Therefore, voltages are applied to electrodes 21 and 22 by which the emitter located between the electrodes 21 and 22 is ionized by the effect of an electric field and is converted to a plasma 3 after a high-current excitation of the emitter has taken place at least once, e.g., preceded by preionization (not shown), to form a dense, hot, compressed plasma 31. Through the radiation emission and expansion of the compressed plasma 31, the latter quickly loses energy and is partially recombined. However, owing to the voltage present at the electrodes 21 and 22, it remains as relaxing plasma 32 in the discharge gap 2.

The lifetime of the plasma 3 commences with the generation of initially compressed plasma 31. If the ionization exceeds a certain value, there is a flow of current between the electrodes 21 and 22 and the magnetic field generated by the flow of current leads to a compression of the plasma 3 due to the pinch effect, and a compressed plasma 31 can be formed which has a high-energy state and whose temperature rises sharply and from which short-wavelength radiation is emitted. The wavelength of the emitted radiation 6 is dependent upon the emitter which is used and upon the temperature of the compressed plasma 31.

At the end of a pulse of the pulse-shaped current, the compressed plasma 31 expands while emitting the desired radiation due to the lapse of the Lorentz force and enters a low-energy state, i.e., the relaxing plasma 32, through charge recombination.

However, before the relaxing plasma 32 completely loses its ionization state and the lifetime of the plasma 3 ends, a next current pulse is already supplied between the electrodes 21 and 22 and a gas discharge is again generated through the electric field between the electrodes 21 and 22. The newly repeated ionization of the emitter can take place much more easily because at least a portion of the emitter, as relaxing plasma 32, was still in the state of simple ionization states. Therefore, a separate preionization is no longer necessary.

Accordingly, at a relatively low required voltage, the relaxing plasma 32 is penetrated by high current strengths which result in the pinch effect and extreme heating by compression. In this way, the state of repeated ionization is again achieved in the compressed plasma 31, i.e., the relaxing plasma 32 is "recycled" and converted to emitting compressed plasma 31. This process of recurring alternating conversion between the compressed plasma 31 and relaxing plasma 32 is repeated without "extinction", i.e., without complete recombination of the ionization of the plasma 3, for as long as emitted radiation 6 is required.

The radiation 6 emitted over the emission duration $t_{emi}$ is collected, directed and supplied for further use in an intermediate focus by suitable means (not shown).

In the above example with a 1-MHz pulse repetition frequency f of the pulse-shaped current, the plasma 3—as the sum occurrence of the phases of compressed plasma 31 and relaxing plasma 32—persists over a lifetime of 1 μs and, in its high-energy state as compressed plasma 31, emits short-wavelength radiation 6 over an emission duration $t_{emi}$ of, e.g., 50 ns. The emission duration $t_{emi}$ amounts to 5% of the duration of the current cycle.

The energy deposited in the relaxing plasma 32 per half-oscillation of the AC current is, for example, 10 mJ and is typically half of the energy of 20 mJ present in the resonant circuit 51. Consequently, in this case, the total power of the resonant circuit 51 is 20 kW, of which 10 kW are deposited in the plasma 3.

Lithium, tin and xenon have become established in the prior art as emitters for generation of radiation of a wavelength of 13.5 nm. Since the first two elements are solids under normal conditions, they are introduced into the discharge gap 2 as vapor or gaseous chemical compound (e.g., SnH4) through the emitter delivery unit 4. But other noble gases or gaseous and vaporous materials are also taken into consideration as emitters insofar as they possess a sufficiently strong emission in the EUV range.

For purposes of describing the design of the discharge circuit under high-frequency excitation by way of example, an optically thin plasma 3 (Xe plasma) with negligible self-absorption is assumed. The emitted radiation 6 is emitted in the solid angle Ω. Accordingly, the emitted power $P_{EUV}$ of the arrangement is given by:

$$P_{EUV}=h\upsilon A_{21}n_i(l\pi r^2)(\Omega/4\pi)t_{emi}f_r, \tag{3}$$

where $n_i$* is the number density of the excited Xe ions; A21 is Einstein's coefficient for spontaneous emission; (lπr2) is the emitting volume, length l=1 mm, pinch radius r=0.5 mm (given by etendue limiting from a particular application in lithography); $t_{emi}$ is the emission duration≈50 ns; f is the pulse repetition frequency≈1 MHz; and hv is photon energy of 92 eV (=13.5 nm wavelength).

Using the formula:

$$dn_i^*/dt=W_{12}n_i-A_{21}n_i^*\approx 0(\text{stationary}), \tag{4}$$

where $n_i$ is the number density of the Xe ions in the ground state and $W_{12}$ is excitation probability 1→2 through electron impact, it follows from (3) that the EUV radiation output is:

$$P_{EUV}=h\upsilon\cdot W_{12}\cdot n_i^*\cdot(l\pi r^2)\cdot(\Omega/4\pi)t_{emi}f, \tag{5}$$

where $W_{12}=2\cdot 10^{-5}\,g\cdot f[\exp(-h\upsilon/kT]/(h\upsilon\,(kT)^{0.5})n_e$; $n_e$ is electron density $-(Z+1)n_i$; Z is the ionization state of xenon≈10 by way of example; g is 0.2; f is 0.8; and kT is 30 eV (plasma temperature).

The usable size of the emitting volume ($l\pi r^2$) is predetermined by optics (not shown) used for collecting and providing the emitted power, e.g., scanner optics. Accordingly, the useable size of the emitting volume is determined by the etendue of the optical system. With larger emitting volumes, there are light losses along the entire beam path.

An emitted power $P_{EUV}$ of >1 kW at a pulse repetition frequency of f≈1 MHz emitted from volume ($l\pi r^2$) in the solid angle Ω is required. According to formula (5), this emitted power $P_{EUV}$ is achieved for Xe ion densities of $n_i > 4 \cdot 10^{16}$ $cm^{-3}$.

To achieve these ion densities $n_i$ at a given pinch radius r, a sufficiently high current I must flow through the cylindrical pinch zone. This can be roughly estimated based on Bennett equilibrium:

$$(l\pi r^2)(Z+1)\cdot n_i kT = 3.12\cdot 10^{15} I^2, kT = 30eV, I(kA). \quad (6)$$

With the data specified above, a current of I≈5 kA results. This current strength is much lower than the usual currents of a pinch zone.

In a very good approximation, the plasma conductivity σ is given by:

$$\sigma(1/\Omega m) = 19200(kT)^{1.5}/(Z^{0.8} InA) kT = 30eV, InA \approx 10. \quad (7)$$

At a current I(t) of 5 kA, a voltage drop across the pinch is about 200 V. As a result, the resistance $R' = (1/\sigma)\cdot l/(\pi r^2)$ of the plasma 3 is 0.026Ω. For efficient power dissipation in the pinch of the compressed plasma 31, the line resistance R" of the electric lines in the discharging circuit should have, at most, this value of 0.026Ω. Accordingly, the total electrical resistance $R_{Peak}$ in the discharging circuit is approximately $R_{Peak} = R' + R'' \approx 0.05\Omega$.

The discharging circuit should be operated in what is known as the oscillation case (high Q circuit). This is the case when the circuit impedance (L/C) is high relative to the electrical resistance $R_{Peak}$. If (L/C) 0.5>>$R_{Peak}/2$, it is assumed that:

$$(L/C)0.5 \approx R_{Peak} = 0.25\Omega. \quad (8)$$

The inductances $L_{Peak}$ in the discharging circuit are ≈30 nH under optimally selected geometry. Inductance $L_{Peak} = L' + L''$ comprises the inductance L' of the plasma 3 and the inductance L" of the peaking circuit 5. This gives a capacitance of C≈480 nF. Like the discharging circuit, the resonant circuit 51 then has a natural frequency $f_0 \approx 1.3$ MHz.

The embodiment example according to FIG. 2 corresponds to that shown in FIG. 1, but in this case the resonant circuit 51 and the electrodes 2 are connected in parallel with the plasma 3 located therein.

Figure 3:
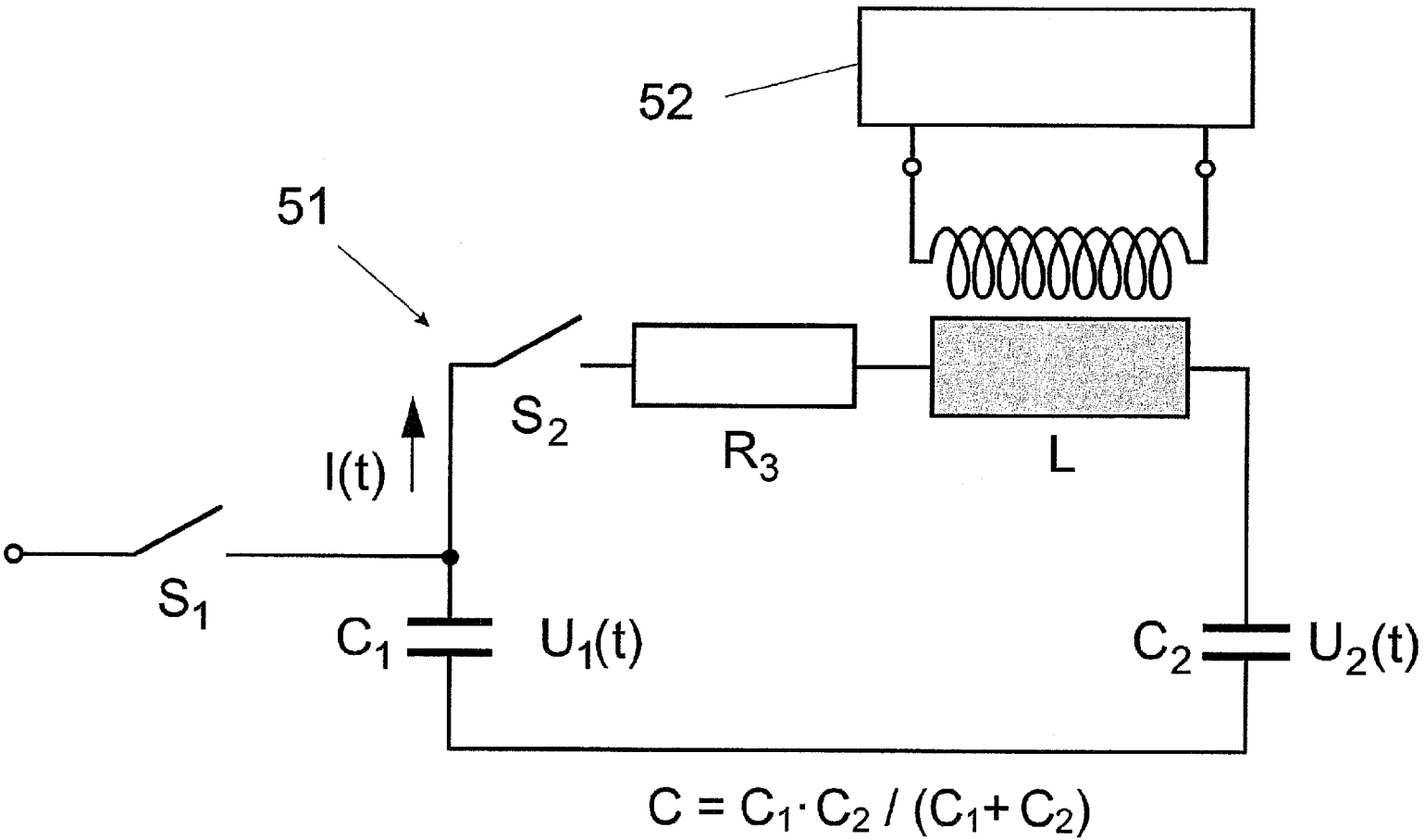
FIG. 3 a schematic layout of the resonant circuit.

In principle, with respect to its resonant circuit 51 in an embodiment example according to FIG. 1 or FIG. 2, the peaking circuit 5 shown in a simplified manner in FIG. 1 and FIG. 2 can be constructed as is shown in FIG. 3.

FIG. 3 shows that the resonant circuit 51 has a first capacitor $C_1$ and a second capacitor $C_2$, each having a voltage curve per time of $U_1(t)$ and $U_2(t)$, respectively, a resistor $R_3$ and an inductor L. The resonant circuit 51 is inductively connected to a high-frequency generator 52 by inductor L. First capacitor $C_1$, resistor $R_3$, inductor L, and second capacitor $C_2$ are arranged successively in the resonant circuit 51 and are electrically conductively connected to one another in that order. The resonant circuit 51 is completed by the connection between the second capacitor $C_2$ and the first capacitor $C_1$. This gives the total capacitance of the resonant circuit 51 as:

$$C = C_1 \cdot C_2/(C_1 + C_2) \quad (9)$$

The resonant circuit 51 according to FIG. 3 is contacted (not shown) by electrically conducting connections in such a way that it realizes the embodiment examples shown in FIGS. 1 and 2, respectively.

A switch $S_2$ is provided in the resonant circuit 51. The switch $S_2$ is arranged between first capacitor $C_1$ and resistor $R_3$.

Further, a charging circuit (not shown) is provided for electrically recharging the first capacitor $C_1$. The peaking circuit 5 is electrically contacted by a line of the charging circuit between first capacitor $C_1$ and resistor $R_3$. A switch $S_1$ is arranged in the line of the charging circuit for switching the line of the charging circuit. A switch $S_2$ is provided between first capacitor $C_1$ and resistor $R_3$ for switching the electrically conducting connection between the first capacitor $C_1$ and resistor $R_3$. The resonant circuit 51 is electrically conductively connected to the electrodes 21 and 22 by lines.

The charging circuit is connected to measuring means (not shown) for determining an energy dissipated in the plasma 3. A matched recharging of the first capacitor $C_1$ is made possible through the design of the charging circuit as a control.

The first capacitor $C_1$ is charged to $U_1 = U_0$ initially by closing switch $S_1$ (switch $S_2$ is open). When switch $S_2$ is closed, there is a flow of current $$I(t) = [U_0/(\omega L)]^* [\exp(-\alpha t)]^* \sin(\omega t), \quad (10)$$

where α=R/2 L and $\omega = [(1/LC) - \alpha^2]^{0.5}$, through the gas discharge in the discharge gap 2.

As was already determined above, the maximum current for the pinch process according to formula (6) must be greater than 5 kA. As a result, the first capacitor C1 must be charged to a voltage of at least $$U_0 > \omega L^* 5kA(L/C)^{0.5} \cdot 5kA = 1.25kV. \quad (11)$$

The first capacitor $C_1$ is recharged periodically by closing $S_1$ and opening $S_2$. This switching process is suitably timed. The first capacitor $C_1$ is recharged when a certain portion of the energy originally deposited therein has been dissipated in the gas discharge in the discharge gap 2. The period for the switching process is advantageously in the time range of about 1/ω to 1/α.

The invention allows generation of short-wavelength radiation as required particularly for lithography applications. In so doing, the supply of radiation is carried out with a high emission duration $t_{emi}$ and high dose stability. At the same time, the charge carriers of the plasma 3 are accelerated less than in the known prior art so that erosion and contamination of all of the components arranged in the neighborhood of the plasma 3 are reduced.

The method according to the invention and the apparatus according to the invention can be used for the machining of materials by means of lithography methods for generating microstructures and nanostructures in the fabrication of semiconductor components.

REFERENCE NUMERALS

1 vacuum chamber
2 discharge gap
21 electrode
22 electrode
3 plasma
31 compressed plasma
32 relaxing plasma
4 emitter delivery unit
41 gas inlet
42 gas feed
5 peaking circuit
51 resonant circuit
52 high-frequency generator
6 emitted radiation L inductor
C capacitor
R electrical resistance (of the peaking circuit)
R' electrical resistance (of the plasma 3)
$R_3$ resistor
$C_1$ first capacitor
$C_2$ second capacitor
I(t) current
$U_1$(t) voltage
$U_2$(t) voltage
$S_1$ switch
$S_2$ switch

What is claimed is:

1. A method for excitation of a gas discharge-based radiation source emitting short-wavelength radiation, comprising:

ionizing an emitter by means of pulse-shaped currents between two electrodes arranged in a vacuum chamber, and further excitation by periodical compression to form a pulsed emitting plasma emitting the desired short-wavelength radiation by each pulse over an emission duration;

maintaining the plasma uninterruptedly by means of a high-frequency sequence of pulse-shaped currents by setting a pulse repetition period of the pulse-shaped currents which is shorter than a lifetime of the plasma corresponding to a duration of presence of the plasma so that the plasma is kept periodically alternating between a high-energy state of an emitting compressed plasma and a low-energy state of a relaxing plasma, and coupling excitation energy into the relaxing plasma for an excitation of the relaxing plasma to generate the emitting compressed plasma, wherein the pulse-shaped currents are generated with a pulse repetition frequency (f) in the range between 50 kHz and 4 MHz and with a pulse width which is equal to the period of pulse repetition frequency (f).

2. The method according to claim 1, wherein said pulse-shaped currents being provided by applying an AC current with a frequency in the range of 50 kHz to 2 MHz.

3. The method according to claim 1, wherein said pulse-shaped currents being provided by a pulsed DC current with a frequency in the range of 100 kHz to 4 MHz.

4. The method according to claim 1, wherein pulse-shaped currents being formed of a function selected from the group comprising sinusoidal, triangular and rectangular functions.

5. The method according to claim 1, wherein no more than 1 joule of the excitation energy is coupled into the relaxing plasma for every excitation of the relaxing plasma to generate the compressed plasma.

6. The method according to claim 1, wherein the pulse repetition frequency (f) is adapted to a natural frequency (f0) of a resonant circuit provided for generating the high-frequency sequence of pulse-shaped currents.

7. The method according to claim 1, wherein the emission duration ($t_{emi}$) is at least 1% of the pulse repetition period.

8. The method according to claim 1, further comprising using a peaking circuit for supplying the pulse-shaped currents, wherein the peaking circuit comprises a resonant circuit containing at least a capacitor (C) and an inductor (L), and a high-frequency generator for inductive excitation of the resonant circuit, wherein the natural frequency ($f_0$) of the resonant circuit is adapted to the desired pulse repetition frequency (f) of the pulse-shaped currents between the electrodes so that the inductivity (L) and the capacitor (C) cause ohmic resistances only and electric energy, that is not coupled into the plasma, is recovered almost in its entirety because of a sufficiently low electrical resistance (R) of the resonant circuit.

9. The method according to claim 1, further comprising recharging the capacitor (C) by a timed supply of electric energy after a defined portion of the energy originally stored therein has been dissipated in the plasma.

10. An apparatus for the excitation of a gas discharge-based radiation source emitting short-wavelength radiation, comprising:

a vacuum chamber in which at least two electrodes are arranged and an emitter is located between the electrodes;

a peaking circuit for generating pulse-shaped currents between the electrodes at a high pulse repetition frequency (f) comprising:

a resonant circuit having at least a capacitor (C) and an inductor (L) to which a high-frequency generator for inductive excitation of the resonant circuit is inductively coupled for generating pulse-shaped currents with a pulse repetition period of the pulse-shaped currents being shorter than a lifetime of the plasma corresponding to a duration of presence of the plasma, so that the plasma is kept periodically alternating between a high-energy state of an emitting compressed plasma and a low-energy state of a relaxing plasma, wherein an excitation energy being coupled into the relaxing plasma for an excitation of the relaxing plasma to generate the emitting compressed plasma;

wherein an excitation is provided by the peaking circuit generating pulse-shaped currents with a pulse repetition frequency (f) in the range between 50 kHz and 4 MHz and with a pulse width which is equal to the period of pulse repetition frequency (f).

11. The apparatus according to claim 10, further comprising:

a charging line for electrically recharging the capacitor (C); through which the peaking circuit is electrically contacted between the capacitor (C) and the inductor (L), and a switch ($S_1$) being arranged along the charging line for switching the line active; and another switch ($S_2$) between the capacitor (C) and the inductor (L) for switching the electrically conducting connection to the inductor (L) off when the first switch ($S_1$) is closed so as to allow a timed recharging of the capacitor (C).

12. The apparatus according to claim 11, wherein the capacitor (C) has an electric capacitance of 300 nF to 600 nF;

the peaking circuit has an inductance (L) of 20 nH to 30 nH; and the peaking circuit has an ohmic resistance (R) of 0.025Ω to 0.05Ω.

13. The apparatus according to claim 10, wherein the resonant circuit comprises a first capacitor ($C_1$), a resistor ($R_3$), an inductor (L), and a second capacitor ($C_2$) being arranged successively in the resonant circuit and being electrically conductively coupled to one another in the above-mentioned sequence and the first capacitor ($C_1$) is electrically conductively connected to the second capacitor ($C_2$).

14. The apparatus according to claim 13, wherein the resonant circuit is electrically contacted through a charging line for electrical recharging supply of the first capacitor ($C_1$), the charging line being arranged between the first capacitor ($C_1$) and the resistor ($R_3$), and a switch ($S_1$) being arranged along the charging line for switching the charging line for timed recharging supply; and another switch ($S_2$) being provided between the capacitor (CO and the resistor ($R_3$) for switching the electrically conducting connection between the charging line and the resistor ($R_3$) so as to allow a timed recharging of the capacitor ($C_1$).

* * * * *